US007043027B2

(12) United States Patent
Wood

(10) Patent No.: US 7,043,027 B2
(45) Date of Patent: May 9, 2006

(54) SYSTEM FOR DETECTING FAILURES IN A LOUDSPEAKER ASSEMBLY

(75) Inventor: Bradley C. Wood, Canoga Park, CA (US)

(73) Assignee: Harman International Industries, Inc., Northridge, CA (US)

( * ) Notice: Subject to any disclaimer, the term of this patent is extended or adjusted under 35 U.S.C. 154(b) by 764 days.

(21) Appl. No.: 09/969,476

(22) Filed: Oct. 1, 2001

(65) Prior Publication Data

US 2002/0071569 A1 Jun. 13, 2002

Related U.S. Application Data

(60) Provisional application No. 60/237,712, filed on Oct. 2, 2000.

(51) Int. Cl.
*H04R 29/00* (2006.01)

(52) U.S. Cl. ..... 381/58; 381/300; 381/306; 381/307

(58) Field of Classification Search ..... 381/300, 381/304, 303, 307, 56, 58, 59; 324/511, 324/523, 527

See application file for complete search history.

(56) References Cited

U.S. PATENT DOCUMENTS

| | | | | |
|---|---|---|---|---|
| 4,852,176 | A * | 7/1989 | Truhe, Jr. | 381/103 |
| 6,052,275 | A * | 4/2000 | Joseph | 361/683 |
| 6,169,806 | B1 * | 1/2001 | Kimura et al. | 381/17 |
| 2002/0193896 | A1 * | 12/2002 | Bull | 381/306 |

* cited by examiner

*Primary Examiner*—Brian T. Pendleton

(57) ABSTRACT

This invention is directed to a system and method for isolating a failure in a speaker system. This is accomplished by providing diagnostic processing circuitry, which directs specific test signal(s) to the speakers of a speaker system. The test signals may be designed to allow a user to directionally localize a sound source to determine if a particular speaker is functional. The test signals also may be designed so a user or listener may distinguish sound emanating from a low frequency driver such as a subwoofer versus other speakers. The diagnostic processing circuitry may be located in any of the individual speakers or other common components of a speaker system.

28 Claims, 3 Drawing Sheets

SYSTEM FOR DETECTING FAILURES IN A LOUDSPEAKER ASSEMBLY

CROSS-REFERENCE TO RELATED APPLICATION

This application claims priority of U.S. Provisional Patent Application No. 60/237,712 filed Oct. 2, 2000.

BACKGROUND OF THE INVENTION

1. Field of the Invention

This invention relates to a system for detecting failures in a loudspeaker system.

2. Related Art

In recent years, the popularity of multimedia loudspeaker systems, particularly those that can be connected to sound sources such as home computers, have gained widespread popularity. As these products are shipped worldwide, increased system complexity has heightened the chance of hardware failures ranging from dropouts of audio and extraneous noises, to complete loss of sound from one or all of the speakers. Other system failures may result from manufacturing defects, user misassembly, or mishandling. Other hardware failures may involve the sound card, the computer, or the speaker system (speaker module). When such failures occur, customer dissatisfaction may result and potentially costly field returns may occur. If a user is not technically proficient, the user may be unable to determine the exact nature of a failure. Worse yet, the user may erroneously determine that the computer system is faulty. In such a case, replacing the computer or a component that has been wrongfully diagnosed will not correct the problem. This, of course, just adds to customer dissatisfaction, along with the cost of trying to solve the problem.

Soundcards from Creative Technology, Ltd., and others have tried sound failure detecting systems to diagnose problems. Such a soundcard system has a resident program on the card that generates audio signals that may be cycled among all of the speakers. The drawback with this approach is that if there is no audio signal at the speakers, it is impossible to determine accurately whether a failure resides in the sound card or in any of the speaker components. Thus, there exists a need for a system that can isolate and localize a failure within a loudspeaker system.

SUMMARY

This invention provides a system for identifying a failure in a loudspeaker system. This may be accomplished by providing processing circuitry capable of directing specific test signal(s) to the loudspeakers of an audio system. The test signal(s) may be designed to allow a user to directionally localize a sound source to determine if a particular speaker is functional. The test signals may be designed so a user or listener may distinguish sound emanating from one loudspeaker versus sound emanating from another loudspeaker. The processing circuitry may be located in any of the individual speakers, or other common components of the audio system including the computer.

This invention utilizes specific test signals with particular harmonic characteristics to provide ease in identifying a loudspeaker emanating the test signal(s). Also, test signals may be utilized that provide ease in recognizing sound emanating from a low frequency driver. The test signals of the invention may be specifically designed for varying types of loudspeakers, such as full range drivers or subwoofers, and optimized for the operating characteristics of a particular loudspeaker. The test signals may be designed so that a test signal emanating from one particular loudspeaker may not be confused from the test signal emanating from a different speaker.

In one embodiment, circuitry used in generating and cycling through test signals for loudspeakers may be relatively simple and inexpensive. For example, analog and digital circuitry in a subwoofer may work in conjunction to cycle test signals through the individual speakers of a speaker system and provide audio feedback to a listener. Additionally, the controls for initiating the test may be located on any speaker component in a speaker system.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
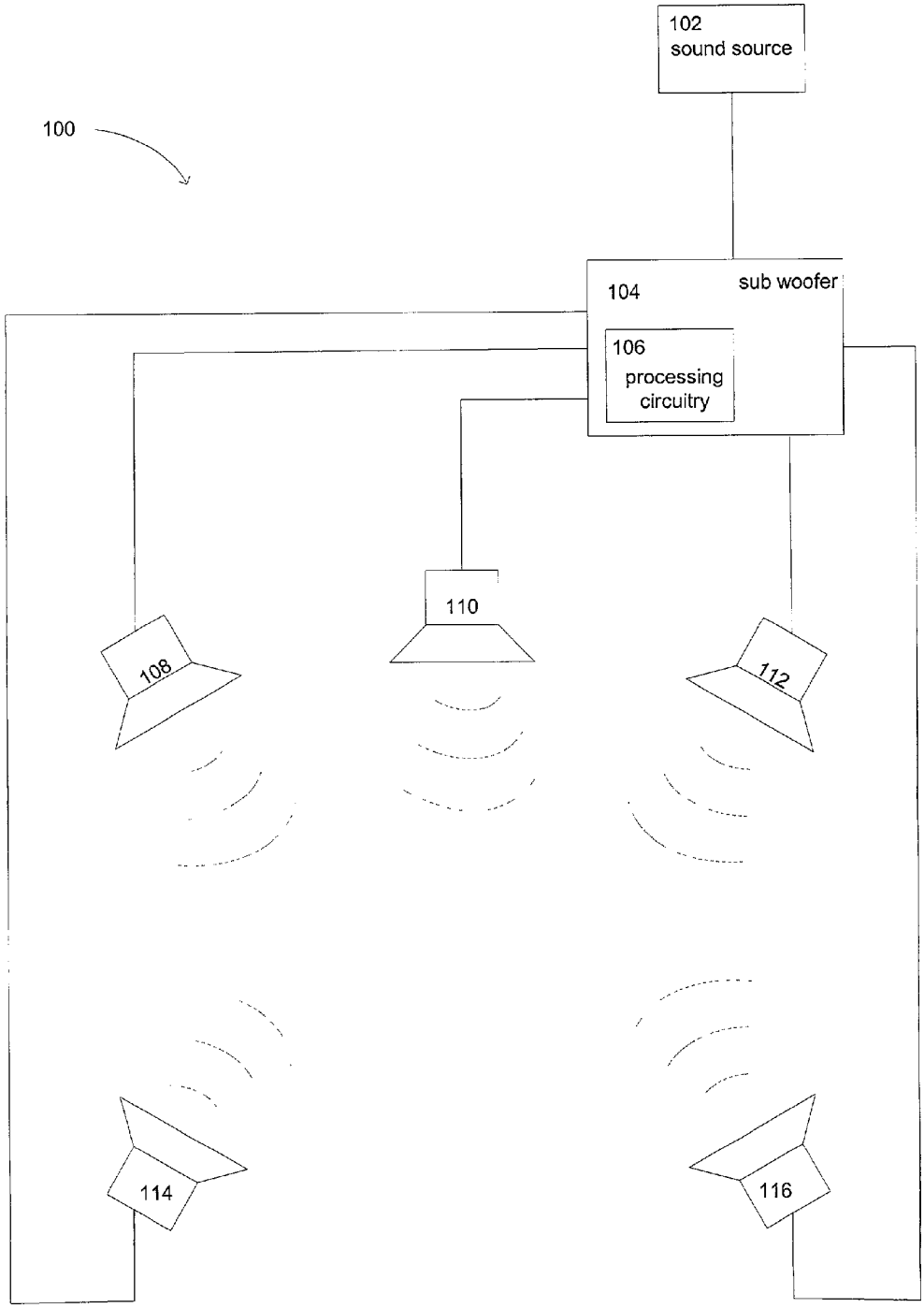
FIG. 1 is a block diagram illustrating a speaker system.

FIG. 1 illustrates an example loudspeaker system 100 where test signals may be acoustically played through a plurality of loudspeakers and/or a subwoofer. The speaker system 100 may include a plurality of loudspeakers 108, 110, 112, 114, 116, a subwoofer 104, and diagnostic processing circuitry 106 capable of executing diagnostic software applications. A sound source 102 may be communicatively coupled to the loudspeakers 108, 110, 114, 116 and subwoofer 104 to provide and transmit an audio signal to the loudspeaker system. The sound source 102 may be circuitry capable of downloading audio from stored files or from a communication network such as the Internet, a CD player, a DVD player, MP-3 player, or other audio/video component capable of generating audio signals such as an audio receiver. The diagnostic processing circuitry 106 may direct test signal(s) to each of the individual loudspeakers 108–116 connected to the audio system including components such as a subwoofer 104. Each individual loudspeaker of any shape, size or configuration such as those employing traditional drivers, transducers or planar magnetic transducers (flat panel speaker systems), may be connected to the sound source 102 via direct wire or wireless connections.

The speaker system 100 may be compatible with a wide range of audio formats known to one skilled in the art, such as Dolby Digital, THX, DTS, etc. Although five individual speakers are shown in the speaker system 100, it is within the scope of the invention to include any number of speakers. For example, the speaker system may only have two individual speakers with or without a subwoofer. Also, the diagnostic processing circuitry 106 may be located in any of the speakers in the speaker system 100, or in the sound source 102. A user interface (not shown) may also be provided on any of the components of the sound system 100 which will allow a user to initiate the diagnostic process. An output device (not shown) such as a light emitting diode or an LCD display may indicate to a user which speaker is being tested.

The diagnostic processing circuitry 106 may execute software applications capable of generating test signal(s) that cycle through the individual speakers 108–116, and the subwoofer 104. The software applications may be designed so that a user or listener may be able to localize the source of the sound being transmitted by a particular speaker and/or accurately associate a test signal with a particular speaker. For example, if a user stands at a location relative to the speakers 108–116, and test signals are transmitted to the subwoofer 104, the user may distinguish the test signals from the subwoofer separate from test signals sent to each of the other speakers. For example, this may be accomplished by generating a harmonically rich diagnostic signal for each one of the individual speakers 108, 110, 112, 114, or 116 and generating a pure sinusoidal tone for the subwoofer 104.

Pure sinusoidal tones of long duration create a pattern of spatial standing waves in any given acoustical environment. Based on the precise location of the listener, the right or left ear may encounter a sound pressure level (SPL) that is higher in the ear further away from the source (speaker), such that the intensity difference is of no help for localization. But a harmonically rich signal of long duration may have a plurality of standing waves, one for each Fourier component of the signal's spectrum. This pattern of standing waves may differ for different components. Thus, a harmonically rich diagnostic signal increases the likelihood that the perceived intensity of the signal to each of the listener's ears may correlate with the distance between the ears and the source of the sound. Accordingly, harmonically rich signals may be used for testing the individual speakers 108–116 because the relative perceived levels may be accurate indications of sound origin. In other words, a user or listener may be better able to ascertain from where the sound is originating. Small motions of the listener's ear may readily introduce changes in the sound pressure level at each ear, due to both the directional filter of the pinnae of the ear and the shift in the position of the ear relative to the plurality of standing waves of the sound field, thus facilitating determination of the sound origin.

Localizing a subwoofer as the source of an audio signal may be more difficult because the subwoofer reproduces low frequency audio signals that are relatively non-directional. However, if the subwoofer sound production can be verified simply by the presence of low-frequency energy distinctly not originating from speakers 108, 110, 112, 114, and 116, then localization of the subwoofer may not be required. If the test signal for the subwoofer is similar to the harmonically rich signal used to diagnose the other speakers, a user may be confused about the origin of the sound. This may be especially true if there is no convenient way to prevent the subwoofer test signal from being fed to one or more of the other speakers. Thus, the test signal for testing the subwoofer may be sufficient for a subwoofer to generate sound but not the other speakers 108, 110, 112, 114, and 116. This way, a listener may verify that the subwoofer is working without other speakers generating sound. This may be accomplished by using a substantially pure sinusoidal waveform (single frequency with little harmonic energy) where the subwoofer may generate sound but not the other speakers so that a listener may verify that the subwoofer is working properly Digital circuits such as microprocessors may be present in the diagnostic processing circuitry 106 in the speaker system, and may be used for controlling audio processors and/or display functions, etc. The microprocessor may be used to generate a repeating sequence of pulses that may approximate or, in conjunction with additional circuitry, allow the synthesis of both harmonically rich and nearly sinusoidal signals.

Figure 2:
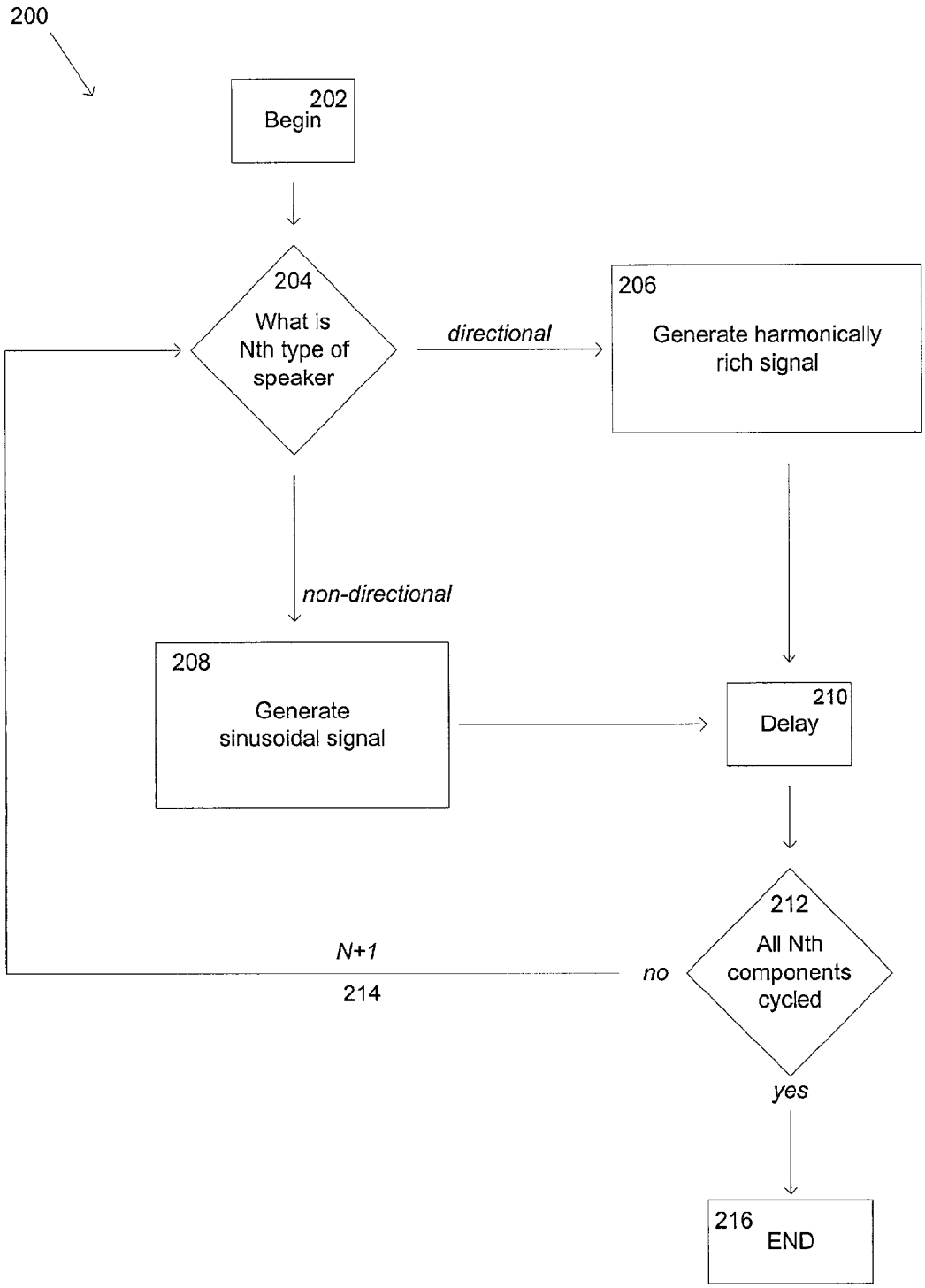
FIG. 2 is a flow chart illustrating the operation of test diagnostics.

FIG. 2 illustrates a flowchart with a diagnostic system methodology 200 for speakers in an audio system 100. The methodology shown in FIG. 2 may be implemented in hardware or by software, or in combination of the two, and may be implemented through any component in the audio system 100. The methodology may be encoded in a software program and a microprocessor may execute the operational steps of the software.

The diagnostic system methodology 200 may test one or a plurality of speakers in an audio system. The diagnostic system methodology 200 may begin at step 202. The type of speaker the method 200 is testing is determined in step 204. Generally, in step 204, the distinction determined may be between a speaker that produces a substantially non-directional audio and a speaker that produces a substantially directional audio. A "directional" speaker may be generally described as sound that can be localized to a particular speaker. If the speaker being tested is a directional speaker 204, then a harmonically rich test signal 206 may be generated. Conversely, if the speaker is a non-directional speaker, then a sinusoidal signal 208 may be generated. After the signal is produced for a predetermined amount of time, whether from step 206 or step 208, a delay may occur 210 for a predetermined period of time. Then the system may check to see if all of the speaker components have been tested 212. If not, a counter may be incremented 214, creating a loop process back to step 204. Conversely, if all of the speakers have been tested, the system ends 216. Alternatively, the test signals may be sequenced and continuously produced to all of the speakers until a user (listener) intervenes to terminate the process.

Figure 3:
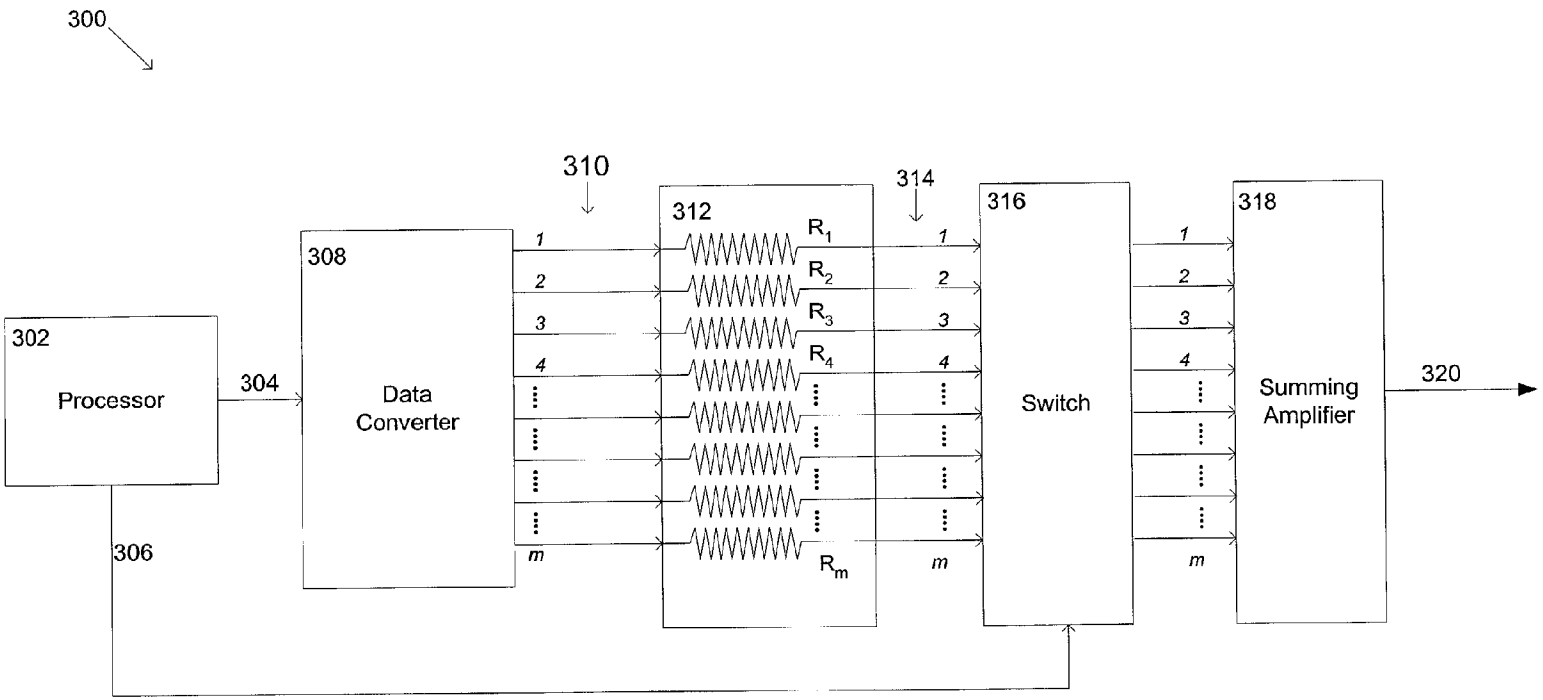
FIG. 3 is a block circuit diagram illustrating a system capable of detecting and isolating failures in audio systems.

FIG. 3 illustrates a block diagram for a diagnostic processing circuitry 300. The diagnostic processing circuitry 300 may include a microprocessor 302, located in an electronic card within the subwoofer assembly or in any component of the audio system 100. The microprocessor 302 may include capabilities for a digitally encoding signal(s) for harmonically rich diagnostic signal(s), digitally encoding signal(s) for sinusoidal diagnostic signal(s), and generating switching signal(s). For digitally encoded signals, there may be a predetermined sequence of generated bits that associate with a given tone. This sequence length may be in the tens or hundreds of bits, and immediately repeats with the repetition rate equal to the reciprocal of the period of the tone, i.e., one cycle of the test signal corresponds to one complete sequence.

Upon receiving an external command (such as that from a user), the diagnostic processing circuitry 300 may deactivate its inputs from the sound source as described above, and engage the testing mode. The external command may be in the form of depressing a button, or any other electrical or electromechanical methodologies known to one skilled in the art.

The microprocessor 302 in the diagnostic processing circuitry 300 may have a plurality of outputs. A first output 304 may be communicatively coupled to a data converter 308 via a serial connection. A second output 306 may be used for transmitting a switching signal to a switch element 316. The signal from the first output 304 may be a serial stream having, at a given time, one of the digitally encoded signals.

The data converter 308 may convert the serial stream of the digitally encoded signal into a parallel signal 310 at the output of the data converter 308. In an alternative embodiment, a microprocessor with multiple data lines at the output may be used to transmit the digitally encoded signals in a parallel form. The parallel output 310 from the data converter 308 may be scaled by a resistor network bank 312 having predetermined resistance values $\{R_1, \ldots R_M\}$. A portion of the resistors that are used from the bank 312 may be realized by a switch 316 that receives the switching signal 306 from the microprocessor 302. For example, the sinusoidal wave encoded signal may correspond to the switch 316 in the "all closed" position, thereby connecting all of the resistors $\{R_1, \ldots R_M\}$ in the resistor bank 312 to be used for scaling the parallel output 310 from the data converter 308. For a harmonically rich signal, the microprocessor 302 may send a switching signal to the switch 316 so that the switch 316 opens one or more of the resistor connections. This way, the switch 316 allows a subset of the resistors $\{R_1, \ldots R_M\}$ in the resistor bank 312 to be used for scaling the parallel output 310 from the data converter 308.

Resistors of varying resistances may be grouped together in a myriad of different combinations to realize the various types of test signals. Moreover, the cost of all the circuitry may be kept relatively low because the disclosed embodiment uses relatively inexpensive components, such as the resistor bank and typical switching, and other circuitry widely used in the art. However, it is within the scope of the invention to use any type of hardware to create the test signals. For example, a microprocessor could generate a pulse width modulated signal that would then be filtered to produce an audio signal.

The scaled output from the resistor bank 312 may be then supplied to a summing amplifier 318 via the switch 316. These components may be a part of the speaker system, or part of a general signal processing system. The summing amplifier 318 may then generate the analog signal to supply to appropriate speaker component in the speaker system. The analog signal may be either harmonically rich or sinusoidal.

Each speaker may be supplied with the appropriate signal for a predetermined amount of time, and then the sequence may repeat itself. There may be a delay of approximately three seconds when the user initiates the test sequence before the signals may be generated, and each speaker may play the test signal for approximately three seconds. The time period of course is not limited to three seconds and it may be varied.

One of the advantages of encoding the analog signal into a digital form and converting the digital signal to a corresponding analog signal is that it eliminates the need for the use of complicated oscillators. Such oscillators generate an analog signal, but they require complex and stabilizing circuitry to maintain a predetermined amplitude level in the analog signals. Furthermore, the circuitry used in the invention for isolating and localizing failures may be also used for other purposes. For example, the parallel output from the data converter 308 may be used for setting different amounts of attenuation or gain associated with surround sound virtualization processing. Thus, cost savings may be realized by making multiple uses of circuit components.

While various embodiments of the invention have been described, it will be apparent to those of ordinary skill in the art that many more embodiments and implementations are possible within the scope of this invention. In particular, many variations of the hardware implementation to generate harmonically rich and sinusoidal tones known to one skilled in the art are within the scope of the invention. Accordingly, the invention is not to be restricted except in light of the attached claims and their equivalents.

What is claimed is:

1. A speaker diagnostic system, comprising:

a microprocessor having a signal in an encoded form, and having a first output and a second output, where the first output is used for transmitting the encoded signal serially and the second output is used for transmitting a switching signal;

a data converter having an input and an output, where the input is connected to the first output from the microprocessor to convert the serial input into a parallel output;

a resistor bank having at least one input terminal and having at least one output terminal, where the input terminal is connected to the output of the data converter, the resistor bank scaling the input from the data converter and transmitting a scaled signal through the output terminal;

a switch having at least three terminals, where a first terminal is connected to the output terminal of the resistor bank, a second terminal is connected to the second output of the microprocessor, and a third terminal is an output from the switch, where the switching signal at the second terminal allows the scaled signal at the first terminal to be transmitted to the third terminal; and a signal processor having an input and an output, where the input is connected to the output from the switch, and the output is connected to the speaker module, the signal processor performing amplification and level shifting on the scaled signal and delivering a signal on the output to the speaker module.

2. The system according to claim 1, where the signal is a test signal.

3. The system according to claim 1, where the encoded signal is in a digital format.

4. The system according to claim 1, where the microprocessor is a microcontroller.

5. The system according to claim 4, where the microcontroller generates the signal as serial data on the first output.

6. The system according to claim 1, where the data converter is a serial to parallel data converter.

7. The system according to claim 1, where the resistor bank has at least one resistor.

8. The system according to claim 7, where each input terminal of a resistor in the resistor bank is connected to a single output from the data converter.

9. The system according to claim 1, where the switch is an electronic switch.

10. A method for generating a signal in a speaker module to detect failure in the module, comprising:

encoding a signal in a microprocessor;

supplying the encoded signal serially from the microprocessor to a data converter;

generating an output from the data converter, where the data converter converts a serial signal into a parallel signal;

applying the parallel signal from the output of the data converter to an input of a network;

generating an output from the network, where the network scales an input signal and provides the sealed signal to an output of said network; and supplying the scaled signal at the output of the network to a speaker module, where the scaled signal provides a predetermined audio signal to a speaker module to inform the listener that the speaker module is functional.

11. The method according to claim 10, where the signal is an analog signal.

12. The method according to claim 11, where the analog signal is a test signal.

13. The method according to claim 12, where the test signal is a sinusoidal tone signal.

14. The method according to claim 12, where the test signal is a harmonically rich signal.

15. The method according to claim 10, where the encoded signal contains digital data.

16. The method according to claim 10, where the signal on the first output is a serial stream of said digital data.

17. The method according to claim 10, where the data converter is a serial to parallel data converter.

18. The method according to claim 10, where the network has at least one weighting resistor, and a summing amplifier.

19. The method according to claim 10, where the output from the network has an analog signal which is applied to the input of a speaker module.

20. The method of claim 10, where the speaker module is a speaker satellite.

21. The method according to claim 10, where the speaker module is a speaker subwoofer.

22. A method for testing a speaker system, comprising:

determining if a speaker is a directional speaker or a non-directional speaker;

generating a harmonically rich signal directed to the speaker if the speaker is a directional speaker; and generating a sinusoidal signal directed to the speaker if the speaker is a non-directional speaker.

23. A system for diagnosing speakers, comprising:

a harmonically rich test signal encoded in a microprocessor;

a pure sinusoidal test signal encoded in the microprocessor;

a non-directional driver communicatively coupled to the microprocessor; and a directional driver communicatively coupled to the microprocessor, where the microprocessor directs the harmonically rich test signal to the directional driver and the microprocessor directs the pure sinusoidal test signal to the non-directional driver.

24. The system according to claim 23, where the non-directional driver is a subwoofer.

25. The system according to claim 23, where the directional driver is a full range driver.

26. The system according to claim 23, where the directional diver is a satellite speaker.

27. The system according to claim 23, where the microprocessor is located inside of the non-directional driver.

28. The system according to claim 23 further comprising a user control interface where the user may activate and deactivate the system.

* * * * *